United States Patent [19]

Takahashi et al.

[11] 4,400,416

[45] Aug. 23, 1983

[54] METHOD OF SURFACE TREATMENT AND AN APPARATUS USED IN SAID SURFACE TREATMENT

[75] Inventors: Yoshinobu Takahashi; Yasuo Tokushima; Kentarou Ogata, all of Toyota; Mamoru Suzuki, Aichi; Zyouzi Ito, Toyota, all of Japan

[73] Assignee: Toyota Jidosha Kogyo Kabushiki Kaisha, Aichi, Japan

[21] Appl. No.: 265,193

[22] Filed: May 19, 1981

[51] Int. Cl.[3] ..... B05D 7/14

[52] U.S. Cl. ..... 427/434.5; 148/6.15 R; 148/6.15 Z; 118/304

[58] Field of Search ..... 427/434.5; 148/6.15 R, 148/6.15 Z; 118/304

[56] References Cited

U.S. PATENT DOCUMENTS 4,196,023 4/1980 Rowe ..... 118/304

4,287,004 9/1981 Murakami et al. ..... 148/6.15 R

*Primary Examiner*—Shrive P. Beck

*Attorney, Agent, or Firm*—Oblon, Fisher, Spivak, McClelland & Maier

[57] ABSTRACT

A method of surface treatment and an apparatus used in said surface treatment are provided in the present invention.

Said method comprises dipping a surface-to-be-treated of an article in a treating liquid, moving said article in said treating liquid, letting the treating liquid flow in the reverse direction against said moving, spraying the treating liquid on the surface-to-be-treated of the article before and/or during said dipping and gush-spraying the treating liquid on the treated surface after said dipping; and said apparatus comprises a tank filled with a treating liquid, spraying tools arranged above and/or in said treating liquid in the front part of said tank, means of overflow formed in the front end of the tank, a container receiving the treating liquid overflowing from said means, a path recirculating the treating liquid from said container to the tank and a spraying tool arranged in the rear part of the tank.

6 Claims, 1 Drawing Figure

METHOD OF SURFACE TREATMENT AND AN APPARATUS USED IN SAID SURFACE TREATMENT

BACKGROUND OF THE INVENTION

1. Field of the Invention

The present invention relates to a new method of surface treatment and a new apparatus used in said surface treatment.

Surface treatment in the invention may include anticorrosive treatment, plating, etching and the like. More particularly, the present invention relates to a new method of surface treatment in which a number of articles to-be-treated are continuously treated in a treating liquid and a new apparatus used in said surface treatment.

2. Description of the Prior Art

The surface treatment comprises making a treating liquid contact a surface-to-be-treated.

Hitherto two methods have been used for making the treating liquid contact with a surface-to-be-treated. One of them comprises spraying the treating liquid on the surface-to-be-treated and the other comprises dipping the surface-to-be-treated in the treating liquid. In the spraying method, the treating liquid is difficult to contact perfectly with the surface-to-be-treated which has complicated shapes such as parts, a body and the like of a car and especially the treating liquid is very difficult to contact with inner faces of a box-shaped article such as a fender, a door, a member and the like, so it can not be avoided for there to remain untreated parts after the surface treatment. In the dipping method, treating liquid is easier to contact perfectly with the surface-to-be-treated than the spraying method, since treating liquid can easily enter the inside of the box-shaped articles to contact their inner faces and little untreated areas remain after the surface treatment but the traces of surface of the treating liquid which are formed on dipping the surface-to-be-treated into the treating liquid remain to form unevenness of the treated surface and the treating liquid is difficult to contact uniformly with the surface-to-be-treated in the case where the surface-to-be-treated is contaminated by water, oil, air, impurities and the like.

SUMMARY OF THE INVENTION

Accordingly, an object of the present invention is to provide a method of surface treatment in which a treating liquid may perfectly contact a surface-to-be-treated.

Another object of the present invention is to provide an apparatus used in said surface treatment.

Further object of the present invention is to provide a method of surface treatment in which a surface-to-be-treated may be uniformly treated by a treating liquid.

Still further object of the present invention is to provide an apparatus used in said surface treatment.

Briefly, these objects of the present invention can be attained by a new method which comprises dipping a surface-to-be-treated of an article in a treating liquid, moving said article in said treating liquid, letting the treating liquid flow in the reverse direction against said moving, spraying the treating liquid on the surface-to-be-treated of the article before and/or during said dipping and spraying the treating liquid on the treated surface after said dipping; and a new apparatus which comprises a tank filled with a treating liquid, spraying tools arranged above and/or in said treating liquid in the front part of said tank, means of overflow formed in the front end of the tank, a container receiving the treating liquid overflowing from said means, a path recirculating the treating liquid from said container to the tank and a spraying tool arranged in the rear part of the tank.

DETAILED DESCRIPTION OF THE PREFERRED EMBODIMENT

Figure 1:
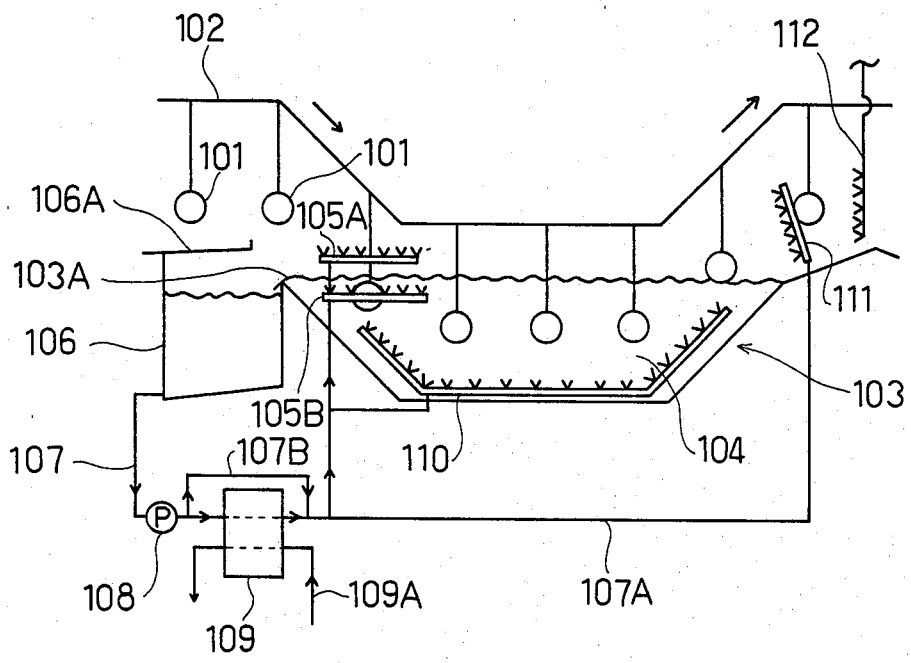
FIG. 1 is a schematic diagram of the preferred embodiment of a surface treatment system according to the present invention.

A preferred embodiment provided herein relates to zinc-phosphating as a pre-treatment of painting of a car body and the like.

In the zinc-phosphating, surfaces-to-be-treated of articles are first treated with trichloroethylene or alkali solution or like to remove the oil matter from said surfaces-to-be-treated of said articles, and then washed by water and usually treated with titanium-phosphate solution to form a seed of a film of titanium-phosphate crystal on the surface-to-be-treated.

After said pre-treatment, said articles-to-be-treated 101 are hung on suspenders 102A of a conveyor 102 moving in the direction shown by an arrow in FIG. 1, and are dipped into zinc-phosphate solution as a treating liquid in the front part of a tank 103. One spraying riser 105A is arranged over the treating liquid and another spraying riser 105B is arranged in the treating liquid and the treating liquid is sprayed on the surface-to-be-treated of the articles 101 from either or both of said spraying risers 105A and 105B.

The spraying riser 105A is arranged in the position such that it can spray the treating liquid on the surface-to-be-treated within 30 sec. before the surface-to-be-treated is dipped into the treating liquid, and the spraying riser 105B is arranged in the position that it can spray the treating liquid on the surface-to-be-treated within a fixed period, 30 sec. in this embodiment, after the surface-to-be-treated was dipped into the treating liquid.

Said spraying should be carried out at least by one spraying riser 105A or 105B, and of course said spraying may be carried out by both of the spraying risers 105A and 105B. It is important that without said spraying unevenness of the treated surface may be formed and further said spraying protects the surface-to-be-treated from the atmosphere to prevent the formation of a bluish ironphosphate layer on the surface-to-be-treated. Said ironphosphate layer is formed by contacting the surface-to-be-treated with the mist and/or vapour of the treating liquid in the presence of the air. In the case that the wetting ability of the surface-to-be-treated is low, spraying from the spraying riser 105A is preferable.

The reason that the spraying riser 105A is arranged in said position is that zinc-phosphate crystal formed on the surface-to-be-treated of the articles 101 becomes a bulky mixed crystal of hopeit and phosphophylite in exposure to the air for more than 30 sec. while said crystal becomes mainly a fine phosphophylite in exposure to the air within 30 sec. and said fine phosphophylite may give the treated surface about one and a half times anticorrosive property as said bulky crystal.

The articles 101 dipped into the treating liquid in the front part of the tank 103 are moving in the direction of the rear part of the tank 103 and while moving, zinc-phosphate crystal grows to cover whole surface-to-be-treated of the articles 101. It usually takes about 60 to 300 sec. to cover the grown zinc-phosphate crystal on the whole surface-to-be-treated. A means of overflow 103A is formed in the front end of the tank 103 and the treating liquid 104 in the tank 103 is overflowed from said means 103A to be received and kept in a container 106.

A shelter 106A is positioned over said container 106 to prevent contacting the mist and/or vapour of the treating liquid 104 with the articles 101. The treating liquid 104 kept in the container 106 is recirculated to the spraying risers 105A and 105B and a lying riser 110 on the bottom of the tank 103 through a recirculating path 107 by a pump 108. Said recirculating path 107 consists of a path passing through a heat exchanger 109 containing a heating medium path 109A for heating the treating liquid and a by-pass 107B by-passes said heat exchanger 109. A flow in the reverse direction against the moving of the articles 101 is given to the treating liquid 104 in the tank 103 in said recirculation of the treating liquid to give a uniform contact between the treating liquid 104 and the surface-to-be-treated of the articles 101.

A spraying riser 111 is arranged in the rear part of the tank 103 and the treating solution is supplied to said spraying riser 111 through a branch path 107A, and the treating liquid sprayed on the treated surface from the spraying riser 111 to wash off the sludge on the treated surface. Further the treated surfaces are washed by water sprayed from a washing riser 112 to remove the remaining sludge on the treated surface, cool the treated surface by withdrawing the heat and prevent drying.

In said treatment, main component of zinc-phosphate film formed on the treated surface of the articles 101 is fine phosphophylite and an excellent anticorrosive surface of the treated article is obtained, and further said zinc-phosphate film is uniformly formed regardless of the shape of the treated article.

As will be obvious to one skilled in the art many modifications, variations, and alterations can be made in the practices of this invention without departing from the spirit and scope thereof as set forth in the claims which follow.

We claim:

1. An apparatus for surface treating articles, comprising:

a dipping tank having a first end and a second end, said dipping tank being adapted to be filled with a treating liquid;

means for moving articles to be treated through said tank in a first direction from said first end toward said second end;

an overflow tank adjacent said first end; and first treating liquid spray means positioned over said tank and above the level of said treating liquid at said first end, second treating liquid spray means positioned below the level of said treating liquid at said first end, said first and second spray means each comprising at least one riser extending parallel to the surface of said liquid and to said first direction, and spray nozzles extending in said first direction on the upper surface of said risers so as to vertically spray said liquid, wherein said first and second risers and said means for moving are constructed and positioned so that said articles are sprayed only within a 30 second period before being dipped in said treating liquid and a 30 second period after being dipped in said treating liquid.

2. The apparatus of claim 1, further including:

third treating liquid spray means adjacent the bottom of said tank; and fourth treating liquid spray means positioned above said liquid at said second end; and means for circulating said treating liquid from said overflow tank to said first, second, third and fourth spray means.

3. The apparatus in accordance with claim 2, wherein said means for moving comprise a conveyor moving a number of said articles and arranged over said tank.

4. The apparatus in accordance with claim 2, wherein said treating liquid is a zinc-phosphate solution.

5. The apparatus in accordance with claim 4, wherein said first spraying means is arranged so as to spray said liquid on the surface-to-be-treated within 30 sec. before the surface-to-be-treated is dipped into the liquid.

6. The apparatus in accordance with claim 4, wherein said second spraying means is arranged so as to spray said liquid on the treated surface within a fixed period after the treated surface is dipped in the liquid.

* * * * *